US006154016A

United States Patent [19]

Hirai

[11] Patent Number: 6,154,016

[45] **Date of Patent: *Nov. 28, 2000**

[54] VOLTAGE-TO-CURRENT CONVERTING CIRCUIT WHICH HAS A WIDE CONTROL RANGE AND WHICH UTILIZES A DEPLETION TYPE FIELD EFFECT TRANSISTOR

[75] Inventor: Kouji Hirai, Kumamoto, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/095,496

[22] Filed: Jun. 11, 1998

[30] Foreign Application Priority Data

Jun. 12, 1997 [JP] Japan ..... 9-155561

[51] Int. Cl.[7] ..... G05F 3/04

[52] U.S. Cl. ..... 323/312

[58] Field of Search ..... 323/312, 315, 323/316, 317; 327/103; 363/73

[56] References Cited

U.S. PATENT DOCUMENTS

| | | | |
|---|---|---|---|
| 4,675,594 | 6/1987 | Reinke | 323/317 |
| 5,424,681 | 6/1995 | Yotsuyanagi | 330/253 |
| 5,463,308 | 10/1995 | Vorenkamp et al. | 323/312 |
| 5,552,730 | 9/1996 | Deguchi | 327/103 |
| 5,610,505 | 3/1997 | Bernardson et al. | 363/73 |

FOREIGN PATENT DOCUMENTS

| | | |
|---|---|---|
| 4-215317 | 8/1992 | Japan . |
| 6-21732 | 1/1994 | Japan . |

*Primary Examiner*—Adolf Deneke Berhane
*Attorney, Agent, or Firm*—Sughrue, Mion, Zinn, Macpeak & Seas, PLLC

[57] ABSTRACT

A voltage-to-current converter is implemented by a series of a load transistor, an output node and an n-channel depletion type field effect transistor applied with a voltage control signal; when the voltage control signal is zero, the n-channel enhancement type field effect transistor flows certain drain current equivalent to standard biasing current; when the voltage control signal is increased from zero to a positive level, the n-channel enhancement type depletion transistor immediately increases drain current so as to achieve a wide control range.

14 Claims, 5 Drawing Sheets

VOLTAGE-TO-CURRENT CONVERTING CIRCUIT WHICH HAS A WIDE CONTROL RANGE AND WHICH UTILIZES A DEPLETION TYPE FIELD EFFECT TRANSISTOR

FIELD OF THE INVENTION

This invention relates to a voltage-to-current converting circuit and, more particularly, to a simple voltage-to-current converting circuit appropriate to a voltage controlled oscillator incorporated in a phase locked loop.

DESCRIPTION OF THE RELATED ARTS

A typical example of the phase locked loop is disclosed in Japanese Patent Publication of Unexamined Application No. 6-283944, and FIG. 1 illustrates the phase locked loop. The phase locked loop comprises a phase frequency detector 1, a charge pump 2, a loop filter 3, a voltage-controlled oscillator 4 and a frequency divider 5. The phase frequency detector 1 is abbreviated as "PFD" in FIG. 1.

The phase frequency detector 1 has two input nodes, and a low-frequency oscillation signal OSC1 and a clock signal CLK1 are supplied to the two input nodes of the phase frequency detector 1. The phase frequency detector compares the low-frequency oscillation signal OSC1 with the clock signal CLK1 to see whether or not the phase and the frequency are matched with each other. If the low-frequency oscillation signal OSC1 is delayed from the clock signal CLK1, the phase frequency detector 1 supplies a first control signal CTL1 indicative of an instruction for acceleration of the oscillation to the charge pump 2. On the other hand, if the low-frequency oscillation signal OSC1 is advanced, the phase frequency detector supplies a second control signal CTL2 indicative of the opposite instruction for deceleration of the oscillation to the charge pump 2.

The charge pump 2 has two control nodes respectively connected to the output nodes of the phase frequency detector 1, and responsive to the first/second control signals CTL1/CTL2 so as to change a control voltage signal CTL3. When the first control signal CTL1 is supplied from the phase frequency detector 1 to the charge pump 2, the change pump 2 increases the potential level of the control voltage signal CTL3. On the other hand, when the second control signal CTL2 arrives at the charge pump 2, the change pump 2 decreases the potential level of the control voltage signal CTL3. The control voltage signal CTL3 is supplied from the charge pump 2 through the loop filter 3 to the voltage-controlled oscillator 4.

Though not shown in the drawings, the loop filter 3 includes a low-pass filter and a capacitor, and stabilizes the control voltage signal CTL3. The voltage-controlled oscillator 4 changes the frequency of an oscillation signal OSC2 in response to the potential level of the control voltage signal CTL3, and the oscillation signal OSC2 is supplied to an internal circuit (not shown) and the frequency divider 5.

The frequency divider 5 reduces the frequency of the oscillation signal OSC2 to 1/n, and supplies the low-frequency oscillation signal OSC1 to the phase frequency detector 1. Thus, the phase locked loop generates the oscillation signal OSC2 in synchronous with the clock signal CLK1, and the frequency of the oscillation signal OSC1 is n times higher than the clock signal CLK1.

FIG. 2 illustrates the voltage-controlled oscillator 4. The voltage-controlled oscillator 4 largely comprises a voltage-to-current converter 4*a* and a current-controlled oscillator 4*b*. The current-controlled oscillator 4*b* is abbreviated as "ICO" in FIGS. 1 and 2, and receives a biassing current signal BS1 produced from the control voltage signal CTL3. The current-controlled oscillator 4*b* changes the frequency of the oscillation signal OSC2 with the biasing current signal BS1.

The voltage-to-current converter 4*a* includes a constant current source 4*c* connected between a power source 4*d* and a ground line GND, a p-channel enhancement type field effect transistor 4*e* connected between a power source 4*f* and the constant current source 4*c* and an n-channel enhancement type field effect transistor 4*g* connected between an output node 4*h* and the ground line GND. The biasing current signal BS1 is supplied from the output node 4*h* to the current-controlled oscillator 4*b*.

The constant current source 4*c* includes a series combination of a resistor 4*j* and an n-channel enhancement type field effect transistor 4*k* connected between the power source 4*d* and the ground line GND and an n-channel enhancement type field effect transistor 4*m* connected between the output node 4*h* and the ground line GND. The gate electrode of the n-channel enhancement type field effect transistor 4*k* is connected to the drain node N1 thereof, and the drain node N1 is further connected to the gate electrode of the n-channel enhancement type field effect transistor 4*m*. The resistor 4*j* and the n-channel enhancement type field effect transistor 4*k* flow constant current from the power source 4*d* to the ground line GND, and adjust the drain node N1 to a certain voltage. The certain voltage is applied to the gate electrode of the n-channel enhancement type field effect transistor 4*m*, and the n-channel enhancement type field effect transistor 4*m* is expected to flow constant current Ic into the ground line GND.

The p-channel enhancement type field effect transistor 4*e* has the gate electrode connected to the output node 4*h*, and varies the channel conductance depending upon the voltage level at the output node 4*h*. The p-channel enhancement type field effect transistor 4*e* supplies current to the n-channel enhancement type field effect transistors 4*g*/4*m*, and produces the biasing current signal BS1.

The control voltage signal CTL3 is supplied to the gate electrode of the n-channel enhancement type field effect transistor 4*g*, and flows variable current Iv depending upon the magnitude of the control voltage signal CTL3. Thus, the total amount of current (Ic+Iv) is varied with the control voltage signal CTL3, and the power voltage line 4*f* supplies the current equal to the current Ic and the current Iv to the output node 4*h*. The biasing current signal BS1 determines the amount of current passing through a constant source of the current-controlled oscillator 4*b* which forms a current mirror circuit together with the p-channel enhancement type field effect transistor 4*e*. The current-controlled oscillator 4*b* oscillates at a frequency equivalent to the amount of current passing through the current source.

As described hereinbefore, the control voltage signal CTL3 is representative of the phase difference between the low-frequency oscillation signal OSC1 and the clock signal CLK1. When the low-frequency oscillation signal OSC1 is in-phase signal of the clock signal CLK1, the control voltage signal CTL3 is maintained at zero volt, and the n-channel enhancement type field effect transistor 4*g* turns off. Only the constant current source 4*c* flows the constant current Ic into the ground line GND, and the biasing current signal BS1 causes the current-controlled oscillator 4*b* to oscillate at a free-running frequency. On the other hand, when the phase difference takes place, the control voltage signal CTL3 causes the n-channel enhancement type field effect transistor 4*g* to flow the variable current Iv, and the voltage-to-current converter 4*a* changes the biasing current signal. Thus, the voltage-to-current converting characteristics are indicated by plots A in FIG. 3.

A problem inherent in the prior art voltage-to-current converter 4*a* is the narrow control range "a". This is because of the fact that the n-channel enhancement type field effect transistor 4*g* starts to flow the variable current Iv at the control voltage signal CTL3 equal to the threshold Vth of the n-channel enhancement type field effect transistor 4*g*. In other words, the voltage-to-current converter 4*a* is not responsive to the control voltage signal CTL3 until the control voltage signal CTL3 equals the threshold Vth of the n-channel enhancement type field effect transistor 4*g*.

Another problem inherent in the prior art voltage-to-current converter 4*a* is a large number of circuit components. The constant current source 4*c* and the n-channel enhancement type field effect transistor 4*g* are connected in parallel between the output node 4*h* and the ground line GND, and the constant current source 4*c* requires the resistor 4*j* and two field effect transistors 4*k*/4*m*. Nevertheless, the constant current source 4*c* is indispensable for the prior art voltage-to-current converter 4*a*, because the constant current Ic determines the free-running frequency for the oscillator 4*b*.

SUMMARY OF THE INVENTION

It is an important object of the present invention to provide a voltage-to-current converter, which has a wide control range and a simple circuit configuration.

To accomplish the object of the present invention, it is proposed to make a depletion type field effect transistor flow a constant current without gate biasing voltage for a free-running frequency.

In accordance with one aspect of the present invention, there is provided a voltage-to-current converter comprising a load element connected between a first power source and an output node for supplying current to the output node and a current controlling transistor connected between the output node and a second power source and implemented by a depletion type field effect transistor so as to vary current passing therethrough in response to a control voltage signal changed from a standard bias level

BRIEF DESCRIPTION OF THE DRAWINGS

The features and advantages of the voltage-to-current converter according to the present invention will be more clearly understood from the following description taken in conjunction with the accompanying drawings in which.

DESCRIPTION OF THE PREFERRED EMBODIMENT

Figure 1:
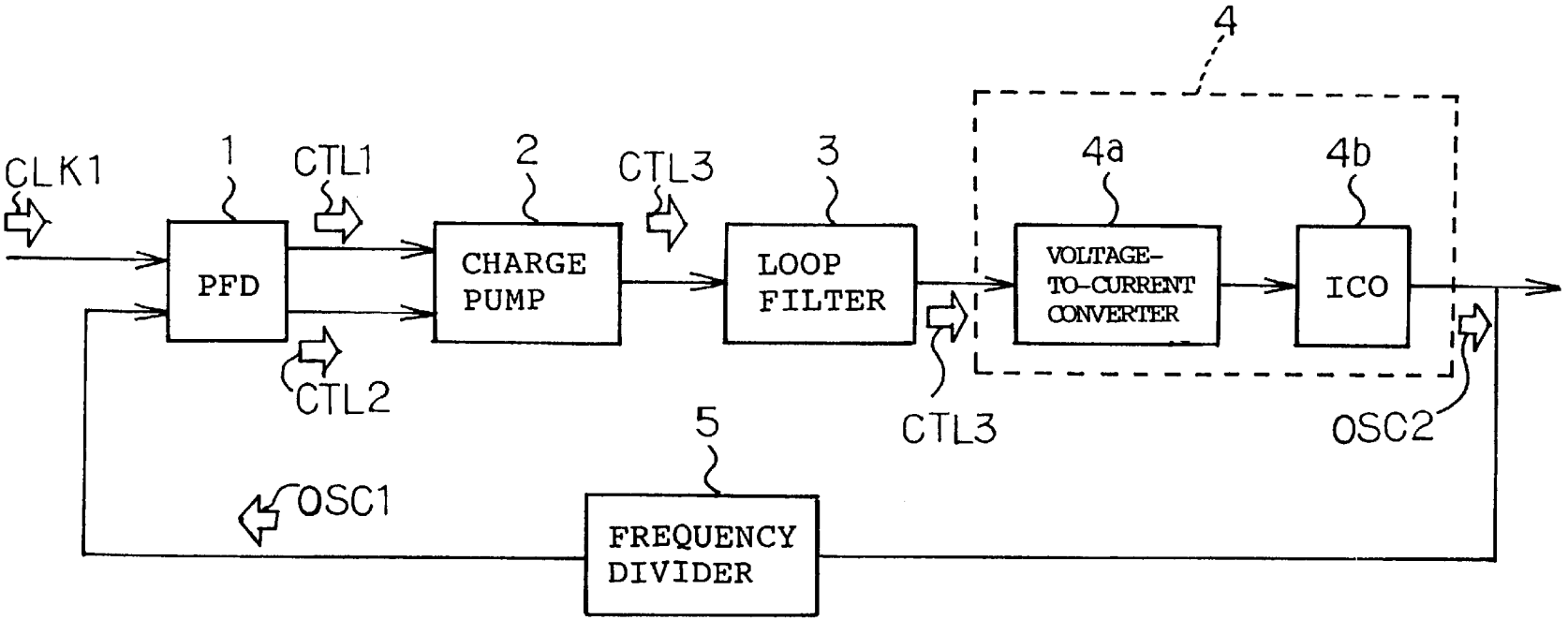
Fig. 1 PRIOR ART
FIG. 1 is a block diagram showing the circuit configuration of the prior art phase locked loop.
Figure 2:
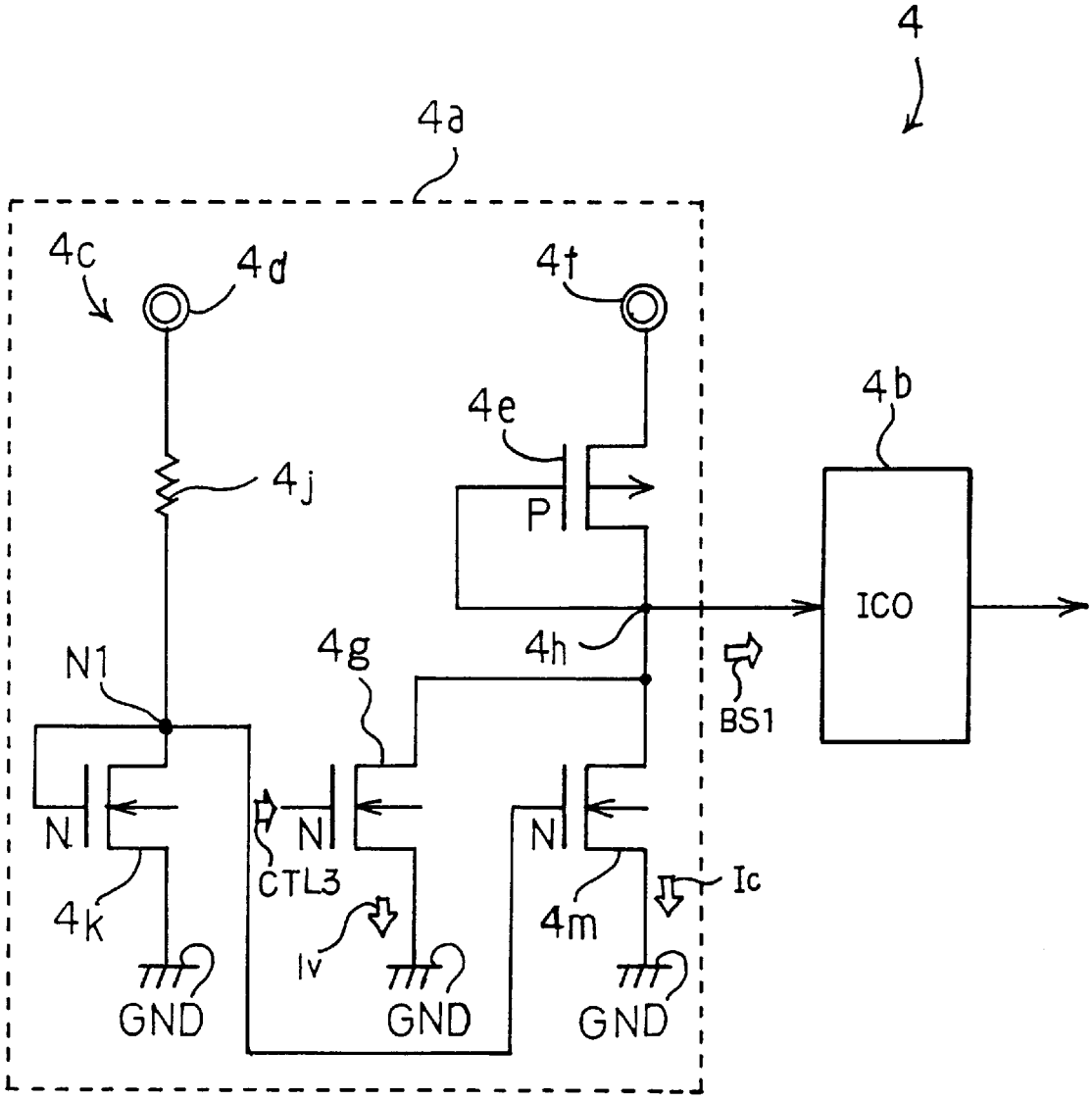
Fig.2 PRIOR ART
FIG. 2 is a circuit diagram showing the configuration of the voltage-controlled oscillator incorporated in the prior art phase locked loop.
Figure 3:
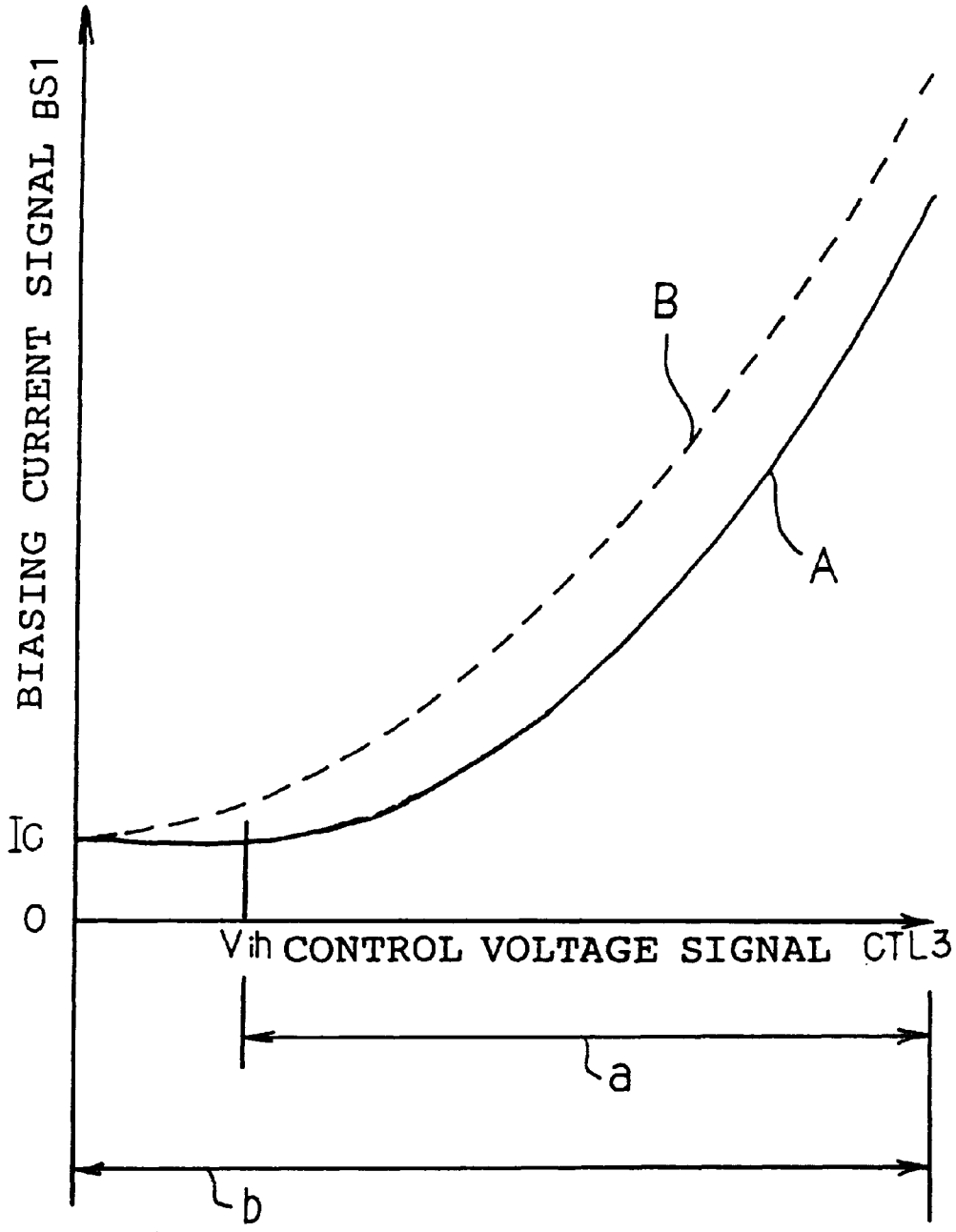
FIG. 3 is a graph showing the voltage-to-current converting characteristics of the prior art voltage-to-current converter and voltage-to-current converting characteristics of a voltage-to-current converter according to the present invention.
Figure 4:
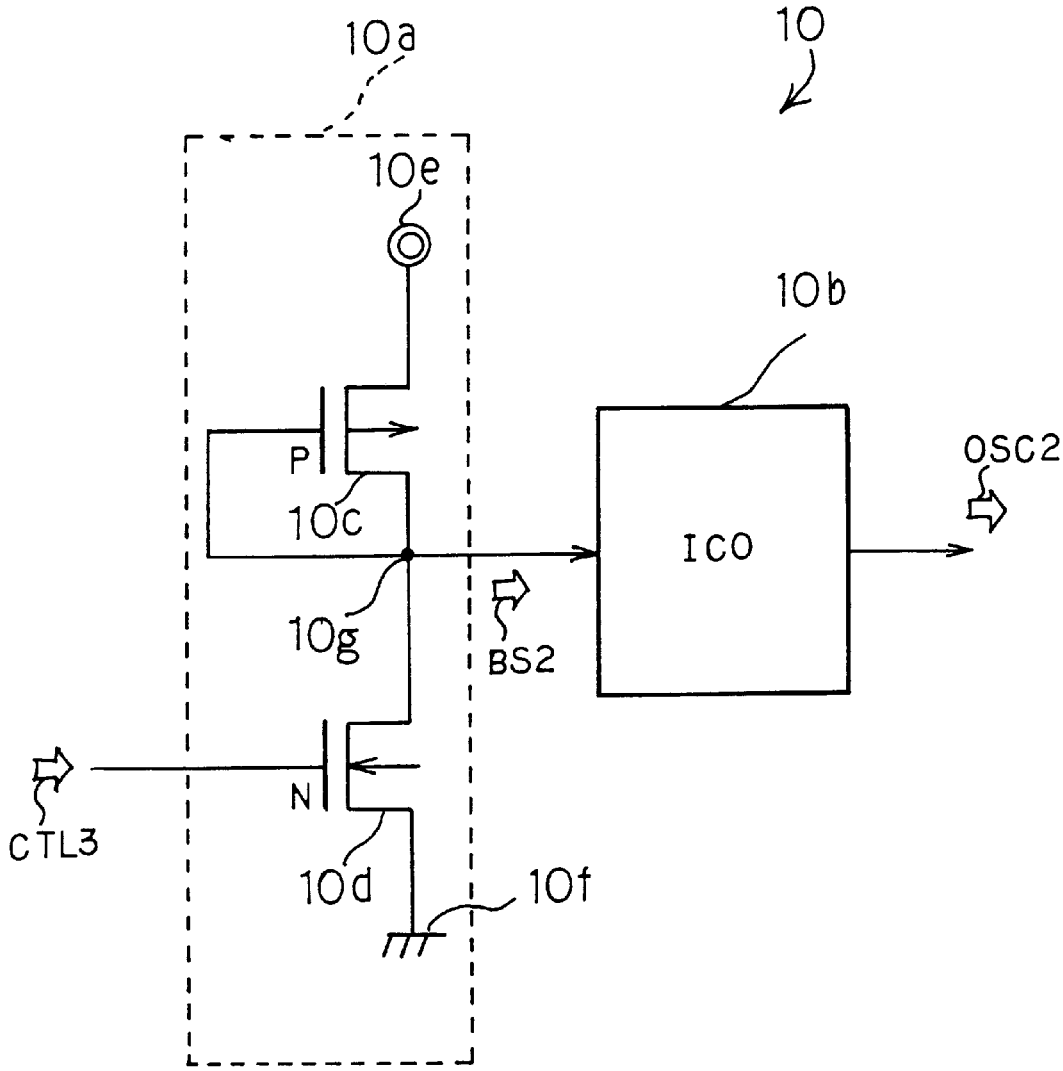
FIG. 4 is a circuit diagram showing the configuration of a voltage-to-current converter according to the present invention.

Referring to FIG. 4 of the drawings, a voltage-to-current converter 10*a* embodying the present invention forms a voltage-controlled oscillator 10 together with a current-controlled oscillator 10*b*. Although the voltage-controlled oscillator 10 forms a part of a phase locked loop, the other components of the phase locked loop are similar to those of the prior art phase locked loop, and are specified by using the same references used in FIG. 1 in the following description.

Description is hereinbelow focused on the configuration and the circuit behavior of the voltage-to-current converter. The voltage-to-current converter 10*a* is implemented by a series combination of a p-channel enhancement type field effect transistor 10*c* and an n-channel depletion type field effect transistor 10*d*, and the series combination is connected between a positive power source 10*e* and a ground line 10*f*. The p-channel enhancement type field effect transistor 10*c* has a gate electrode connected to an output node 10*g*, and the control voltage signal CTL3 is supplied to the gate electrode of the n-channel depletion type field effect transistor 10*d*. The n-channel depletion type field effect transistor 10*d* flows constant drain current Ic without any gate bias voltage or zero volt, and increases the drain current together with the magnitude of the control voltage signal CTL3. The power voltage line 10*e* supplies current equal to the drain current to the output node 10*g*. The biasing current signal BS2 determines the amount of current passing through a constant source of the current-controlled oscillator 10*b* which forms a current mirror circuit together with the p-channel enhancement type field effect transistor 10*c*. The current-controlled oscillator 10*b* oscillates at a frequency equivalent to the amount of current passing through the current source.

As will be understood from the foregoing description, the n-channel depletion type field effect transistor 10*d* not only determines the constant current Ic for the free-running frequency but also varies the frequency of the oscillating signal OSC2. In other words, the n-channel depletion type field effect transistor 10*d* achieves both functions of the constant current source 4*c* and the n-channel enhancement type field effect transistor 4*g*. As a result, the circuit configuration of the voltage-to-current converter 10*a* is simplified, and the component elements are drastically decreased. In this instance, the p-channel enhancement type field effect transistor 10*c* serves as a load element.

The p-channel enhancement type field effect transistor 10*c* supplies drain current through the output node 10*g* to the n-channel depletion type field effect transistor 10*d*, and a biasing current signal BS2 is supplied from the output node 10*g* to the current-controlled oscillator 10*b*.

When the low-frequency oscillating signal OSC1 is the in-phase signal of the clock signal CLK1, the control voltage signal CTL3 is maintained at zero volt, and the n-channel depletion type field effect transistor 10*d* flows the constant drain current Ic under the non-biased state. Then, the biasing current signal BS2 causes the current-controlled oscillator 10*b* to oscillate at the free-running frequency.

On the other hand, if the phase difference takes place between the low-frequency oscillating signal OSC1 and the clock signal CLK1, the charge pump 2 increases the magnitude of the control voltage signal CTL3, and, accordingly, the n-channel enhancement type field effect transistor 10*d* increases the channel conductance. As a result, the biasing current signal BS2 decreases the potential, and the current-controlled oscillator 10*b* advances the oscillating signal OSC2. Thus, the voltage-to-current characteristics of the converter 10*a* is represented by plots B, and the control range is increased from "a" to "b".

The voltage-to-current converter 10*a* is appropriate to the voltage-controlled oscillator 10, because the control range is wide. The voltage-to-current converter 10*a* is desirable for an integrated circuit, because the circuit components are reduced rather than the prior art.

When the frequency ratio "n" between the oscillating signal OSC1 and the low-frequency oscillation signal OSC2 is two, the phase locked loop equipped with the voltage-to-current converter according to the present invention is appropriate to a double rate data transmission technology, and may form a part of a high-speed semiconductor memory device such as, for example, a synchronous DRAM (Dynamic Random Access Memory) device.

As will be appreciated from the foregoing description, the voltage-to-current converter according to the present invention makes the control range wide and the circuit configuration simple.

The simple circuit configuration reduces the current consumption to a half of the current consumption of the prior art voltage-to-current converter.

The voltage-to-current converter according to the present invention is less affected by fluctuation of transistor characteristics, because a small number of component elements forms the voltage-to-current converter. The free-running frequency does not widely fluctuate, and allows a designer to determine the minimum oscillating frequency to be low.

Although a particular embodiment of the present invention has been shown and described, it will be apparent to those skilled in the art that various changes and modifications will be made without departing from the spirit and scope of the present invention.

Figure 5:
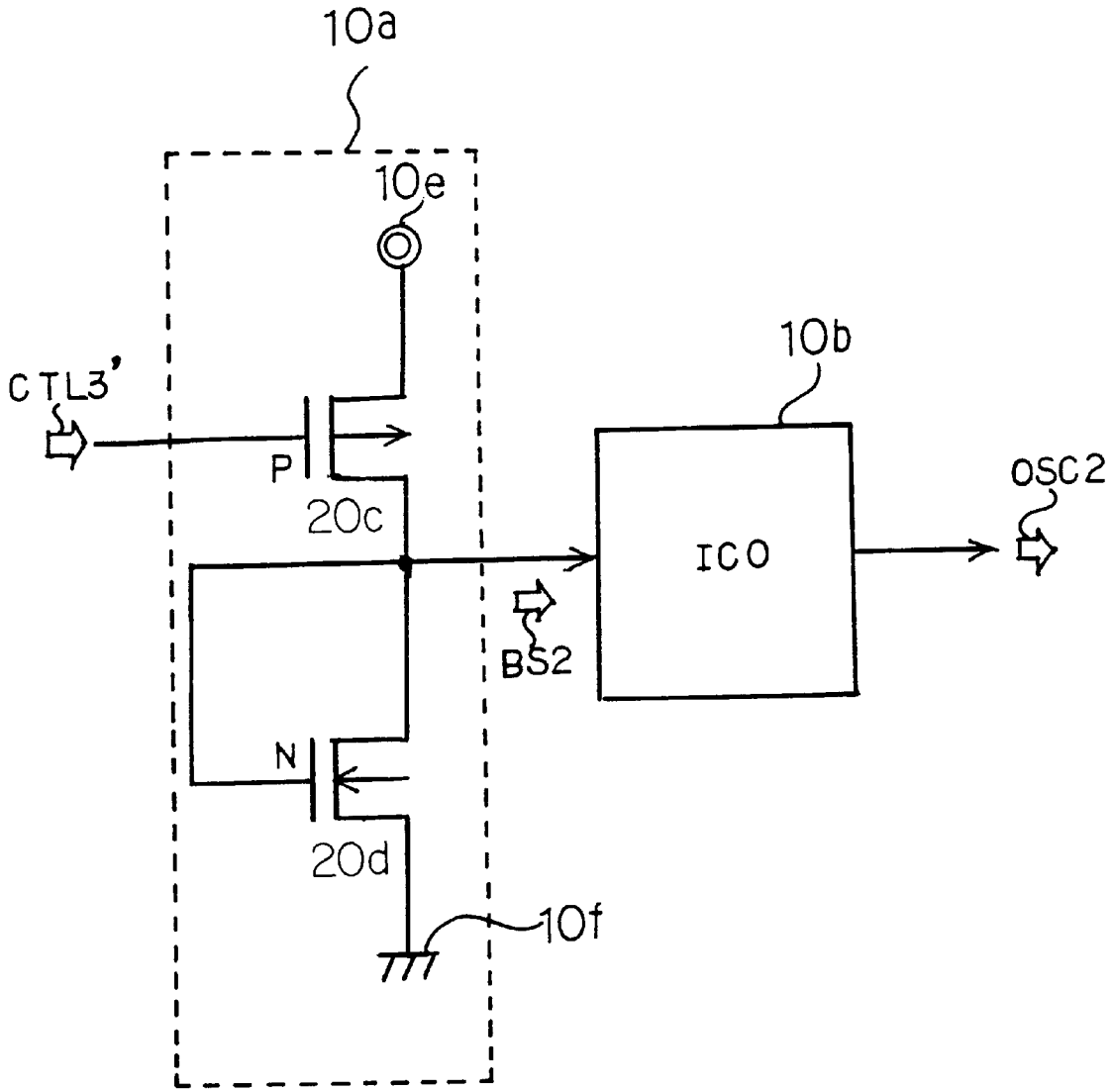
FIG. 5 is a circuit diagram showing the configuration of a modification of the voltage-to-current converter.

For example, a p-channel depletion type field effect transistor 20*c* (with an n-channel enhancement type field effect transistor 20*d*) is available as shown in FIG. 5. In this instance, the voltage control signal CTL3' decreases the magnitude from the non-biasing state.

Moreover, the depletion type field effect transistor 10*d*/20*c* may determine the free-running frequency at negative/positive biasing state.

What is claimed:

1. A voltage-to-current converter comprising:

a voltage clamping element connected between a first power source and an output node for supplying current to said output node, and a current controlling transistor connected between said output node and a second power source and implemented by a depletion type field effect transistor so as to vary current passing therethrough in response to a control voltage signal changed from a standard bias level.

2. The voltage-to-current converter as set forth in claim 1, in which a biasing current signal is supplied from said output node to a current-controlled oscillator, and said biasing current signal at said standard bias level determines a free-running frequency of said current-controlled oscillator.

3. The voltage-to-current converter as set forth in claim 2, in which said current-controlled oscillator forms a voltage-controlled oscillator together with said voltage-to-current converter, and said voltage-controlled oscillator forms a part of a phase locked loop.

4. The voltage-to-current converter as set forth in claim 3, in which said phase locked loop further includes a comparator operative to compare a first oscillating signal with a clock signal so as to produce an instruction signal representative of current status between said first oscillating signal and said clock signal, a voltage signal generating circuit responsive to said instruction signal for producing said control voltage signal.

5. The voltage-to-current converter as set forth in claim 4, in which said comparator is implemented by a phase frequency detector, and said voltage signal generating circuit has a charge pump connected to said phase frequency detector and a loop filter connected between said charge pump and said current controlling transistor.

6. The voltage-to-current converter as set forth in claim 4, in which said phase locked loop further includes a frequency divider connected between said voltage-controlled oscillator and said comparator for producing said first oscillating signal from a second oscillating signal output from said voltage-controlled oscillator.

7. The voltage-to-current converter as set forth in claim 1, in which said voltage clamping element is a p-channel enhancement type field effect transistor in which said depletion type field effect transistor has an n-type conductivity channel at said standard bias level and in which there are only two field effect transistors.

8. The voltage-to-current converter as set forth in claim 7, in which said standard bias level is zero volt, and said depletion type field effect transistor flows a certain drain current at said standard bias level.

9. The voltage-to-current converter as set forth in claim 8, in which a biasing current signal is supplied from said output node to a current-controlled oscillator, and said certain drain current determines a free-running frequency for said current-controlled oscillator.

10. The voltage-to-current converter as set forth in claim 1, in which said depletion type field effect transistor has a p-type conductive channel at said standard bias level.

11. The voltage-to-current converter as set forth in claim 1, in which said voltage clamping element is implemented by a p-channel enhancement type field effect transistor, which has a gate electrode connected to said output node.

12. The voltage-to-current converter as set forth in claim 1, wherein there are only two field effect transistors, wherein said voltage clamping element is an n-channel enhancement type field effect transistor, and wherein said depletion type field effect transistor has a p-type conductivity channel at said standard bias level.

13. A voltage-to-current converter responsive to a control voltage signal for supplying a biasing current signal from an output node, said converter having only two field effect transistors and comprising:

a single p-channel enhancement type field effect transistor connected between a source of positive power voltage and said output node and having a gate electrode connected to said output node, and a single n-channel depletion type field effect transistor connected between said output node and a source of ground level and having a gate electrode supplied with said control voltage signal.

14. A voltage-to-current converter responsive to a control voltage signal for supplying a biasing current signal from an output node, said converter having only two field effect transistors and comprising:

a single n-channel enhancement type field effect transistor connected between a source of ground level and said output node and having a gate electrode connected to said output node, and a single p-channel depletion type field effect transistor connected between said output node and a source of positive power voltage and having a gate electrode supplied with said control voltage signal.

* * * * *